US006068878A

United States Patent [19]

Alwan

[11] Patent Number: 6,068,878

[45] Date of Patent: May 30, 2000

[54] METHODS OF FORMING LAYERS OF PARTICULATES ON SUBSTRATES

[75] Inventor: James J. Alwan, Boise, Id.

[73] Assignee: Micron Technology, Inc., Boise, Id.

[21] Appl. No.: 09/146,731

[22] Filed: Sep. 3, 1998

[51] Int. Cl.[7] ..... B05D 1/20

[52] U.S. Cl. ..... 427/77; 427/180; 427/202; 427/282; 427/434.3

[58] Field of Search ..... 427/430.1, 434.3, 427/282, 180, 203, 58, 77, 202; 118/402; 101/492

[56] References Cited

U.S. PATENT DOCUMENTS

| | | | |
|---|---|---|---|
| 4,093,757 | 6/1978 | Barraud et al. | 427/434 A |
| 4,511,604 | 4/1985 | Barraud et al. . | |
| 4,599,969 | 7/1986 | Barraud et al. . | |
| 4,695,480 | 9/1987 | Belovet . | |
| 4,779,562 | 10/1988 | Ono . | |
| 4,783,348 | 11/1988 | Albrecht et al. | 427/402 |
| 5,286,529 | 2/1994 | Nakayama et al. . | |
| 5,512,326 | 4/1996 | Albrecht et al. | 427/430.1 |
| 5,536,982 | 7/1996 | Mino et al. . | |

OTHER PUBLICATIONS

Product Information Brochure: "For tomorrow's world . . . KSV—Langmuir Instrument Specialist, KSV 5000", KSV Instruments Ltd., 7 pages undated.

*Primary Examiner*—Fred J. Parker
*Attorney, Agent, or Firm*—Wells, St. John, Roberts, Gregory & Matkin, P.S.

[57] ABSTRACT

A method of forming a layer of particulates on a substrate includes fastening the substrate to a support and submerging at least a portion of the substrate in a liquid. The liquid has particulates suspended on an upper surface thereof. The submerged substrate is moved relative to the suspended particulates to form a layer of the particulates supported on the substrate. After the layer of particulates is formed on the substrate, the substrate is removed from the support.

23 Claims, 9 Drawing Sheets

METHODS OF FORMING LAYERS OF PARTICULATES ON SUBSTRATES

PATENT RIGHTS STATEMENT

This invention was made with government support under Contract No. DABT63-97-C-0001 awarded by Advanced Research Projects Agency (ARPA). The government has certain rights in this invention.

TECHNICAL FIELD

The invention pertains to methods of forming layers of particulates on substrates, to methods of forming field emission emitter tips, and to associated apparatuses.

BACKGROUND OF THE INVENTION

Field emitters are widely used in display devices. An exemplary display device is a flat panel display. Clarity, or resolution, of a field emission display is a function of a number of factors, including emitter tip sharpness. Specifically, sharper emitter tips can produce higher resolution displays than less sharp emitter tips. Accordingly, numerous methods have been proposed for fabrication of very sharp emitter tips (i.e., emitter tips having tip radii of 100 nanometers or less).

Fabrication of very sharp tips has, however, proved difficult. It has proved particularly difficult to build large areas of sharp emitter tips using photolithography while maintaining resolution and stringent dimensional control over large area substrates used for display manufacture. In light of these difficulties, it would be desirable to develop alternative methods of forming emitter tips. Several methods have been proposed. Some utilize deposited particulates to form a non-photolithographic etch mask. A subsequent etching step, or series of steps, then forms emitter tips. The use of deposited particulates on a substrate as an etch mask can reduce complexity of an etching process and improve sharpness of emitter tips relative to photolithographic processing. It would, therefore, be desirable to develop alternative methods for utilizing deposited materials in etch masking processes.

In other aspects of the prior art, it is frequently desired to form uniform layers of particulates on substrates. Such can occur through, for example, Langmuir-Blodgett technologies. It would be desirable to develop methods and apparatuses for automating formation of uniform layers of particulates on substrates.

SUMMARY OF THE INVENTION

In one aspect, the invention encompasses a method of forming a layer of particulates on a substrate. A first substrate is fastened to a second substrate. While the first substrate is fastened to the second substrate, at least a portion of the first substrate is submerged in a liquid. Particulates are suspended on an upper surface of the liquid. The submerged first substrate is moved relative to the suspended particulates to form a layer of the particulates supported on the first substrate. The first substrate is subsequently removed from the second substrate.

In another aspect, the invention encompasses another method of forming a layer on a substrate. A liquid is provided in a vessel and particulates are suspended on an upper surface of the liquid. A pusher bar is provided to compress the particulates against one another. A conveyor having substrates fastened thereto is provided. The conveyor is drawn into the liquid and upwardly through the suspended particulates. The substrate is drawn upwardly through the suspended particulates with the conveyor. As the substrate is drawn upwardly, the suspended particulates adhere to it to form a layer of the particulates supported on the substrate.

In yet another aspect, the invention encompasses a layer forming apparatus. The apparatus comprises a vessel configured to retain a liquid, and a pusher bar joined to the vessel and configured to compress particulates on an upper surface of the liquid. The apparatus further comprises a conveyor which enters and exits the vessel. The conveyor is configured to removably retain substrates and to transport such substrates through the vessel. The vessel, conveyor and pusher bar are configured to form a layer of the particulates on substrates as the substrates are transported through the vessel by the conveyor.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
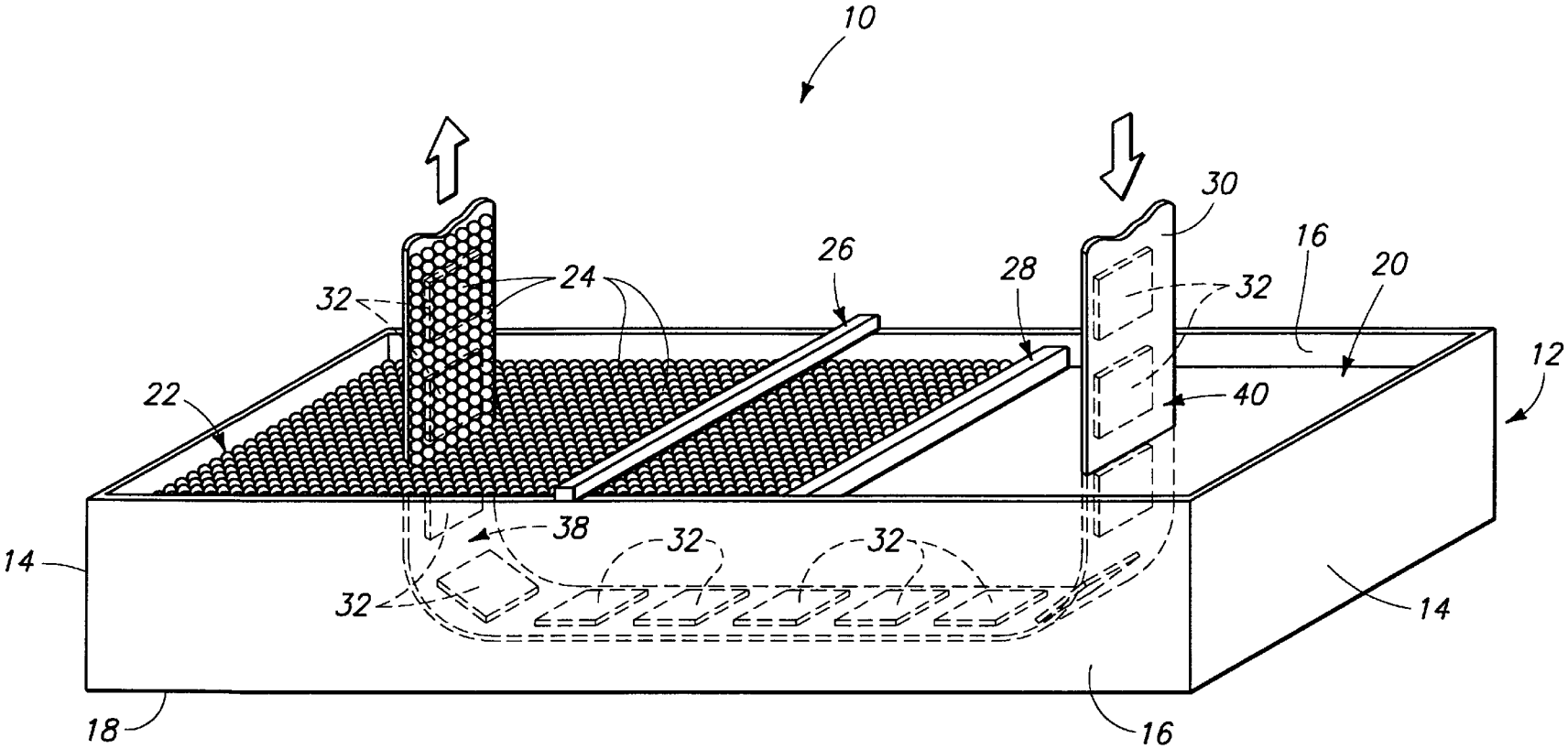
FIG. 1 is a diagrammatic, fragmentary, perspective view of a layer-forming apparatus encompassed by the present invention.

The present invention encompasses methods of forming layers of particulates on substrates. An exemplary apparatus 10 for accomplishing a method of the present invention is illustrated in FIG. 1. Apparatus 10 comprises a vessel 12 having end walls 14 and side walls 16. Vessel 12 further comprises a bottom 18. Vessel 12 extends longitudinally between end walls 14 and laterally between side walls 16.

A liquid 20 is provided within vessel 12. Liquid 20 has an upper surface 22. Liquid 20 can comprise, for example, water.

Particulates 24 are suspended on an upper surface of liquid 20 to form a monolayer. The term "monolayer" refers to a layer of particulates 24 having a thickness of a single particulate. Particulates 24 can be macroscopic (such as, example, polystyrene beads), or microscopic (such as, for example, single molecules).

A dispenser 26 is provided to dispense particulates 24 onto upper surface 22. Dispenser 26 can, for example, comprise a housing over a conveyer (not shown), with the conveyer being in communication with a storage container (not shown) of particulates 24.

A pusher bar 28 is provided to compress particulates 24 against one another to form a "tightly packed" monolayer. The term "tightly packed" is defined to mean that particulates 24 physically contact one another throughout the monolayer, rather than being dispersed from one another. A "uniform tightly packed monolayer" is defined as a layer of particulates 24 wherein all of the particulates 24 are physically against other particulates and form a single layer atop liquid 20.

Pusher bar 28 is connected to a mechanism (not shown) to push a surface of pusher bar 28 against particulates 24 (the surface pushed against particulates 24 can be referred to as a "pushing surface"). Preferably, the mechanism which pushes pusher bar 28 is configured to maintain a substantially constant pressure of pusher bar 28 against particulates 24 so as to maintain a uniform tightly packed monolayer of particulates 24 on upper surface 22 of liquid 20. Pusher bar 28 is also preferably connected through a feedback loop to a mechanism (not shown) configured to measure a surface tension at surface 22 to ascertain that a tightly packed monolayer is obtained (i.e., configured in accordance with, for example, a Wilhelmy plate method or a Langmuir film balance method). Pusher bar 28 has a back surface in opposing orientation to the pushing surface. The liquid upper surface 22 proximate the pusher bar back surface is not be covered with particulates 24.

A conveyor 30 extends into liquid 20 at one end of vessel 12, and extends out of liquid 20 at another end of vessel 12. In the shown preferred embodiment, conveyor 30 enters liquid 20 through the portion of liquid upper surface 22 that is not coated with particulates 24. The exemplary shown conveyor 30 is a belt, but it is to be understood that the invention encompasses other embodiments (not shown) wherein conveyor 30 comprises other conveying structures such as, for example, moving cables or chains. Belt 30 is a preferably continuous belt attached to a mechanism (not shown) which pulls belt 30 through liquid 20 in the direction indicated by the arrows at the fragmentary ends of belt 30. Only a portion of the preferred continuous belt 30 is shown to increase clarity in the drawings. Belt 30 can comprise, for example, rubber, fabric and/or metal. For example, belt 30 can comprise a flexible polymer film, such as Mylar™. As another example, belt 30 can comprise a thin metallic sheet, or a composite of assembly of materials comprising linked subsections.

Figure 9:
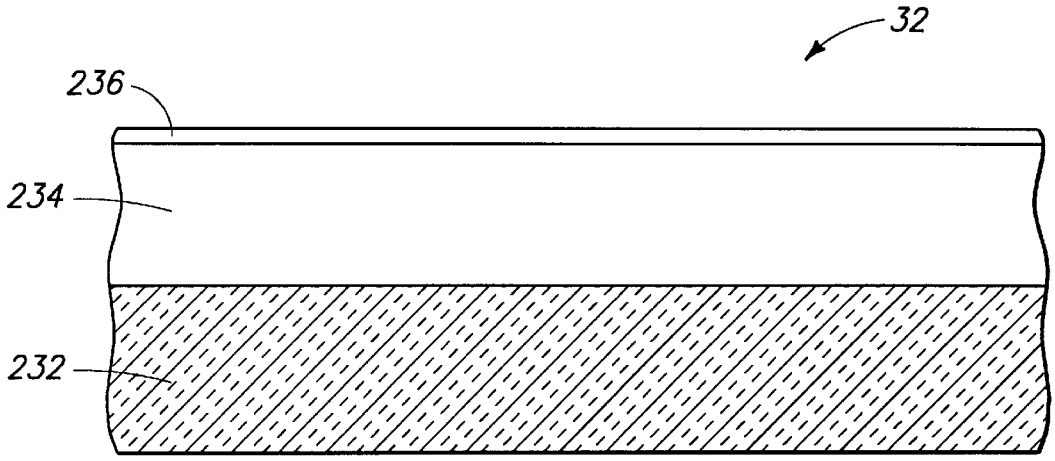
FIG. 9 a diagrammatic, fragmentary, cross-sectional view of a an exemplary substrate that can be processed according to a method of the present invention.

A plurality of substrates 32 are fastened to belt 30 and pulled through liquid 20 by belt 30. It is noted that belt 30 can, in one aspect, be considered as a first substrate to which second substrates 32 are fastened. Substrates 32 can comprise, for example, the construction illustrated in FIG. 9, which includes a glass backing 232, a semiconductive material layer 234 overlying glass backing 232, and a masking material layer 236 overlying semiconductive material layer 234. Semiconductive material layer 234 can comprise, for example, monocrystalline silicon lightly doped with a p-type dopant. To aid in interpretation of this disclosure and the claims that follow, the term "semiconductor substrate" is defined to mean any construction comprising semiconductive material, including, but not limited to, bulk semiconductive materials (either alone or assemblies comprising other materials thereon), and semiconductive material layers (either alone or assemblies comprising other materials). The term "substrate" refers to any supporting structure including, but not limited to, the semiconductor substrates described above. Masking layer 236 of the FIG. 9 substrate can comprise, for example, silicon dioxide. The illustrated substrate 32 of FIG. 9 can be utilized for forming emitter tips, as will be discussed in more detail below with reference to FIGS. 10–14.

Referring again to FIG. 1, belt 30 comprises a frontside 38 which faces pusher bar 28 as belt 30 is drawn out of liquid 20, and a backside 40 in opposing orientation to frontside 38. Substrates 32 are attached to frontside 38. In the shown embodiment, both frontside 38 and backside 40 are exposed to the monolayer of particulates 24 as belt 30 is drawn upwardly through the monolayer. Thus, both frontside 38 and backside 40 are coated with particulates, as are substrates 32. Preferably, the pressure exerted by pusher bar 28 is sufficient to form a tightly packed monolayer of particulates on substrates 32. In alternative embodiments (not shown) belt 30 can be configured such that particulates 24 do not adhere to belt 30. Such configuration can comprise, for example, forming belt 30 of a material that will not stick to particulates 24 or covering belt 30 with a coating to which particulates 24 will not stick.

In subsequent processing (not shown), substrates 32 are removed from belt 30. After such removal, particulates 24 can also be removed from belt 30 by, for example, a vacuum device (not shown) configured to draw the particulates off from belt 30 and return the particulates to dispenser 26.

Figure 10:
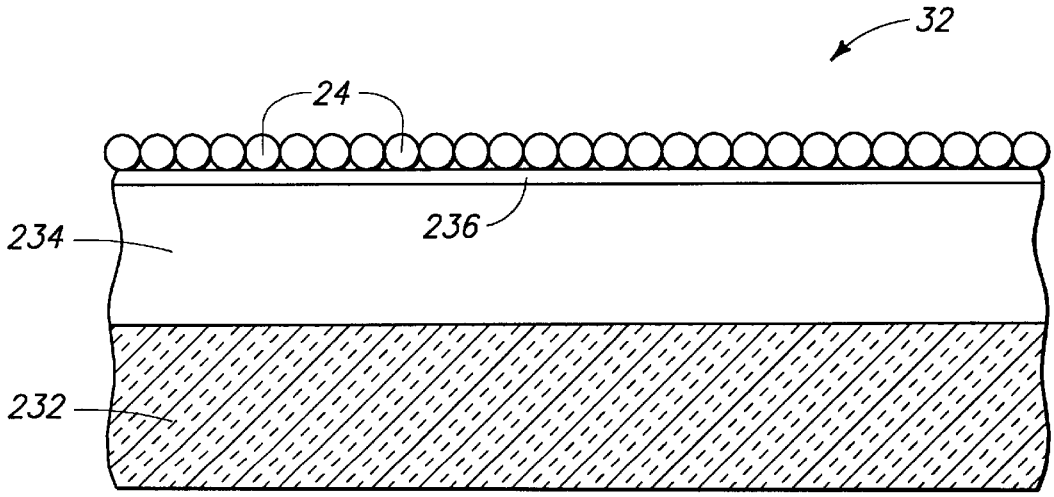
FIG. 10 is a view of the FIG. 9 substrate shown at a processing step subsequent to that of FIG. 9.

An exemplary substrate 32 is shown in FIG. 10 after the treatment of FIG. 1. The substrate 32 of FIG. 10 is identical to that of FIG. 9 in all respects, except that a monolayer of particulates 24 is now supported by masking material layer 236.

In the shown preferred embodiment of FIG. 1, substrates 32 are substantially perpendicular to upper surface 22 of liquid 20 as the substrates are drawn through the monolayer of particulates 24 suspended on upper surface 22. Such preferred configuration is found to more consistently yield tightly packed monolayers on substrates 32 than other configurations wherein substrates 32 are pulled through upper surface 22 at angles other than perpendicular.

Figure 2:
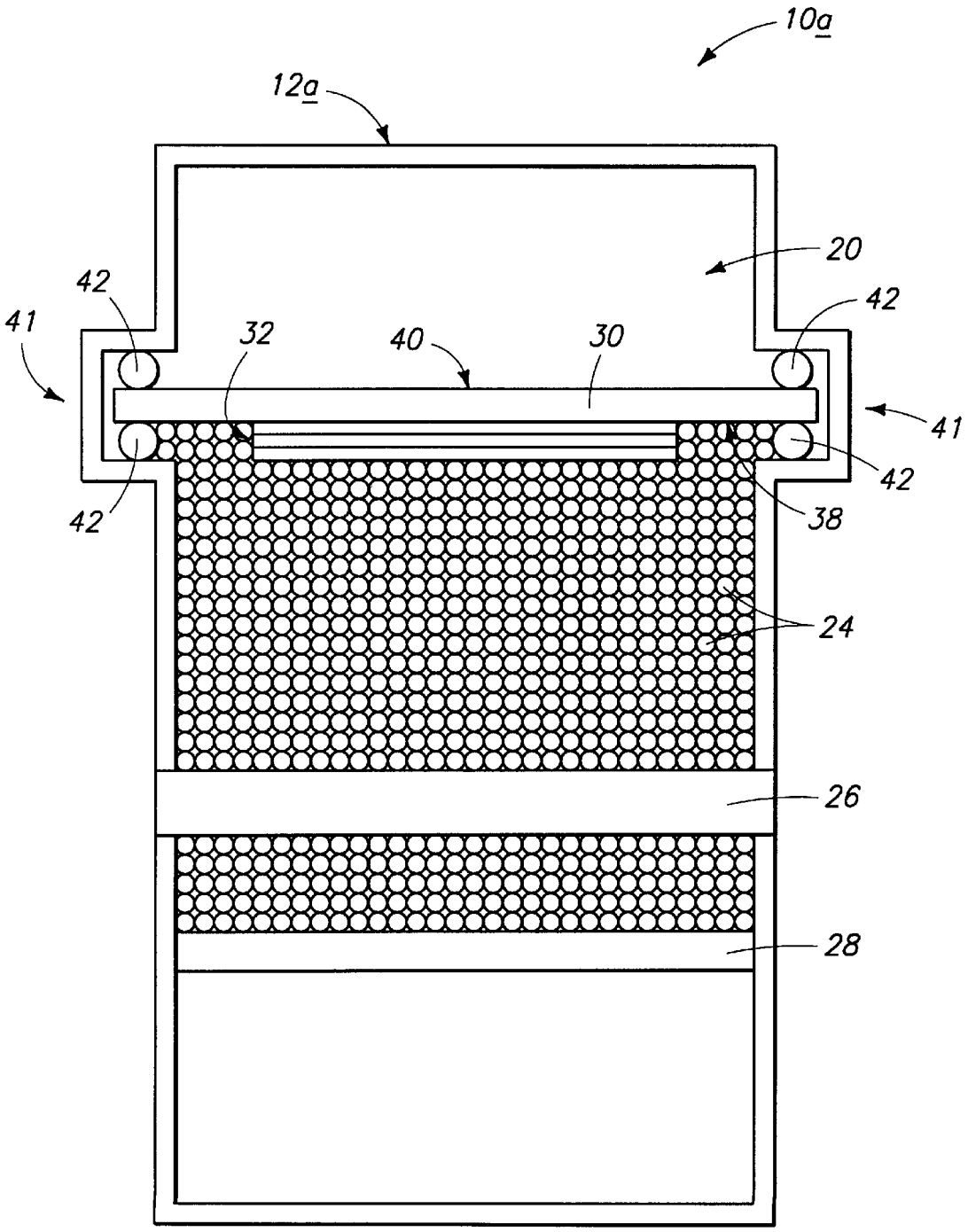
FIG. 2 is a diagrammatic, top-view of a second embodiment layer-forming apparatus encompassed by the present invention.

A second embodiment apparatus of the present invention is illustrated in FIG. 2. In referring to FIG. 2, similar numbering to that utilized above in describing the embodiment of FIG. 1 will be used, with differences indicated by the suffix "a" or by different numerals.

FIG. 2 illustrates an apparatus 10*a* for forming a layer of particulates on a substrate. Apparatus 10*a* comprises a vessel 12*a* containing a fluid 20. Apparatus 10*a* further comprises a particulate dispenser 26 and a pusher bar 28. Particulate dispenser 26 dispenses particulates 24 onto an upper surface of fluid 20. Pusher bar 28 compresses particulates 24 into a tightly packed monolayer. A belt 30 comprising a substrate 32 fastened thereto is pulled upwardly through the monolayer to form a monolayer of particulates 24 on a surface of substrate 32. Belt 30 has a frontside 38 and a backside 40.

Vessel 12*a* comprises laterally projecting grooves 41 into which peripheral portions of belt 30 extend. Additionally, vessel 12*a* comprises sealing members 42 within grooves 40. Sealing members 42 can comprise, for example, gasket materials, such as, for example, rubber, TEFLON™ or plastic. Belt 30 is drawn upwardly between sealing members 42. Sealing members 42 prevent particulates 24 from migrating to backside 40 of belt 30.

It is noted that in the embodiment of FIG. 2 pusher bar 28 defines a back surface of a monolayer of particulates 24 suspended on an upper surface of liquid 20, and belt 30 defines a front surface of such monolayer. Specifically, there is no portion of the front surface of the monolayer of particulates 24 suspended on fluid 20 that is not against either belt 30 or the substrate 32 fastened thereon. Accordingly, an entirety of such front surface of particulates 24 is exposed to upward movement of belt 30, which can alleviate formation of channels of nonmoving particulates 24 on upper surface 20. Such channels of nonmoving particulates 24 can be problematic, as they can result in discontinuities in a monolayer formed over a substrate 32 as the substrate is pulled through the suspended particulates 24.

Yet another embodiment of the invention is described with reference to FIG. 3. In referring to the embodiment of FIG. 3, similar numbering to that utilized above in describing the embodiment of FIG. 1 will be used, with differences indicated by the suffix "b" or by different numerals.

Figure 3:
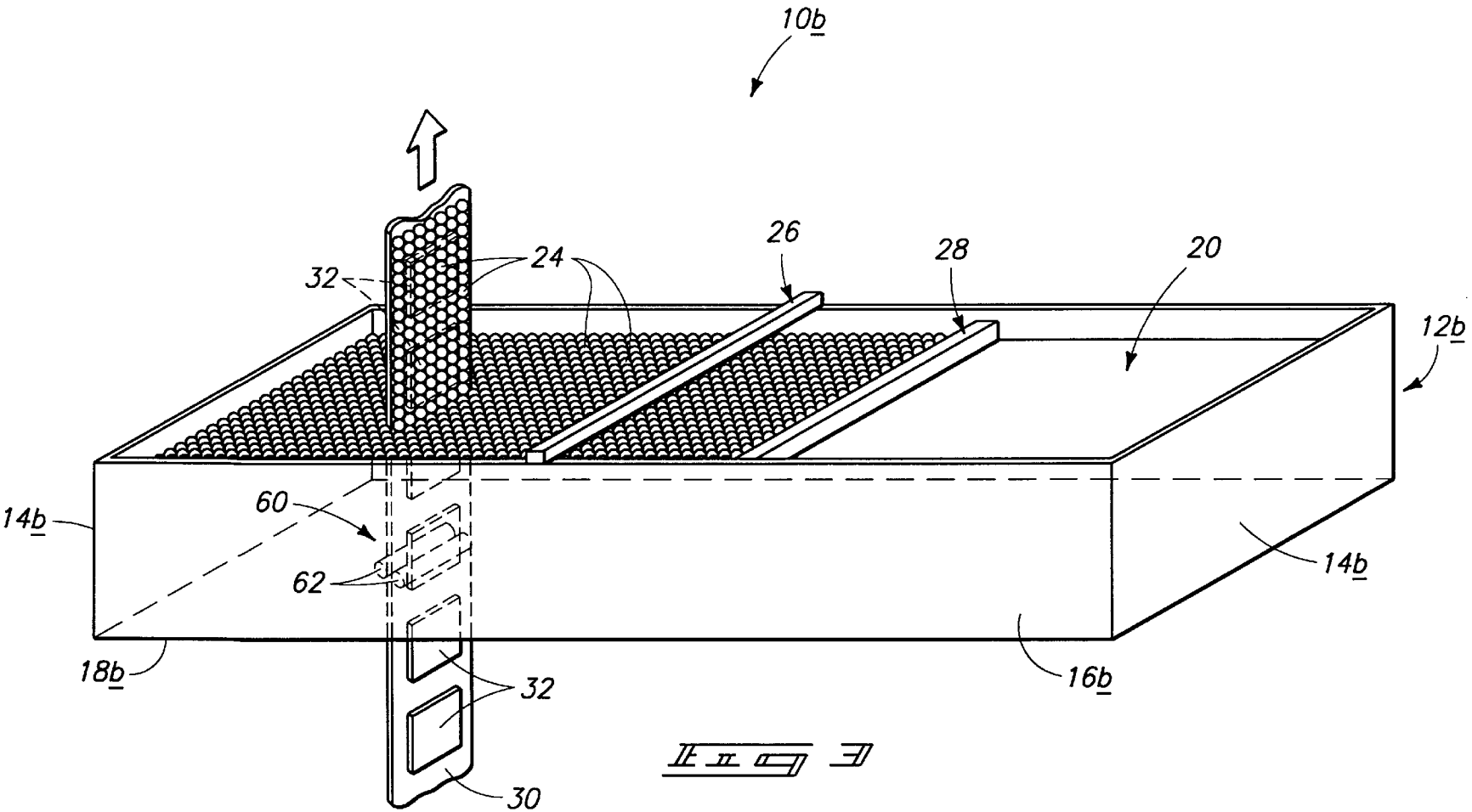
FIG. 3 is a diagrammatic, fragmentary, perspective view of a third embodiment layer-forming apparatus encompassed by the present invention.

FIG. 3 illustrates an apparatus 10*b* for forming a layer of particulates on a substrate. Apparatus 10*b* comprises a vessel 12*b*, having endwalls 14*b* and sidewalls 16*b*. Vessel 12*b* further comprises a bottom 18*b* having an opening 60 formed therethrough. A liquid 20 is provided within vessel 12*b*, and a layer of particulates 24 is provided on an upper surface of liquid 20.

A belt 30 having substrates 32 fastened thereto is pulled through opening 60 and upwardly through particulates 24 to form a monolayer of particulates 24 on substrates 32.

Opening 60 can comprise a relatively flexible sealant material 62 provided against belt 30 to form a fluid-tight seal in conjunction with belt 30. In the shown preferred embodiment, sealant material 62 is provided in the form of rollers. In alternative embodiments which are not shown, the sealant material can be provided in other forms, such as, for example, a gasket. In yet other alternative embodiments, the sealant can be eliminated, or else loosely provided, such that opening 60 leaks fluid 20 as belt 30 is pulled therethrough. The leaked fluid can then be captured in a holding reservoir (not shown) and transferred back to vessel 12*b* by a pumping mechanism (not shown).

In each of the above-discussed embodiments of FIGS. 1–3, a substrate 32 is fastened to belt 30. Methods of fastening substrates 32 to belt 30 are discussed with reference to FIGS. 4–8.

Figure 4:
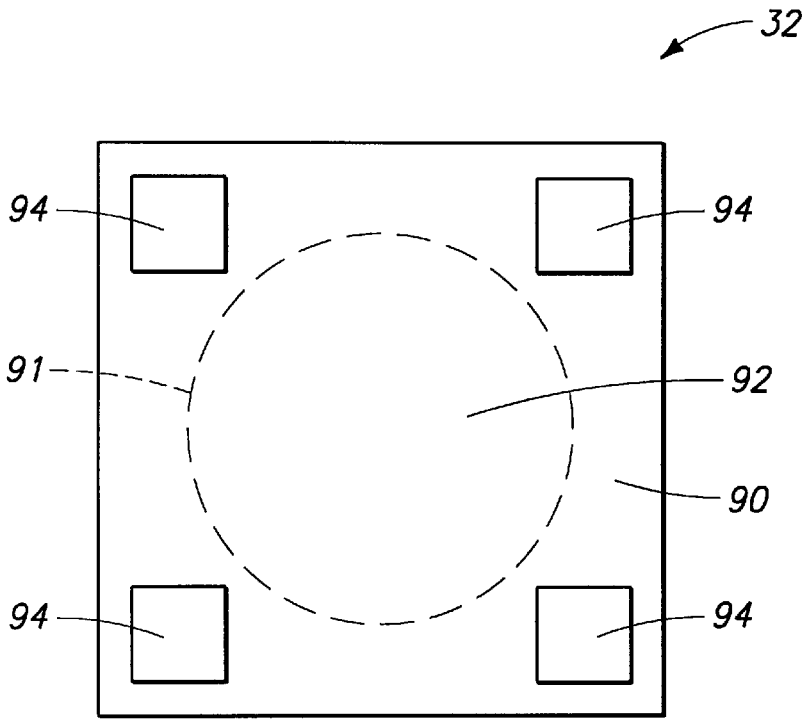
FIG. 4 is a view of a backside of a substrate prepared in accordance with one aspect of the present invention.

Referring first to FIG. 4, a backside of a substrate 32 is illustrated in accordance with a first embodiment method of fastening the substrate to a belt 30. The backside of substrate 32 comprises a peripheral region 90, and a central region 92 surrounded by peripheral region 90. In the shown embodiment, central region 92 is separated from peripheral region 90 by an imaginery boundary illustrated by dashed line 91. An adhesive material 94 is provided within peripheral region 90 (shown as being provided at corners of square substrate 32) and not within central region 92. Adhesive material 94 can comprise, for example, a paste, glue or adhesive tape. An exemplary material for adhesive 94 is a double-sided adhesive tape. Adhesive 94 is preferably removable from substrate 32. Such removability enables adhesive 94 to be removed prior to subsequent processing of substrate 32.

Figure 5:
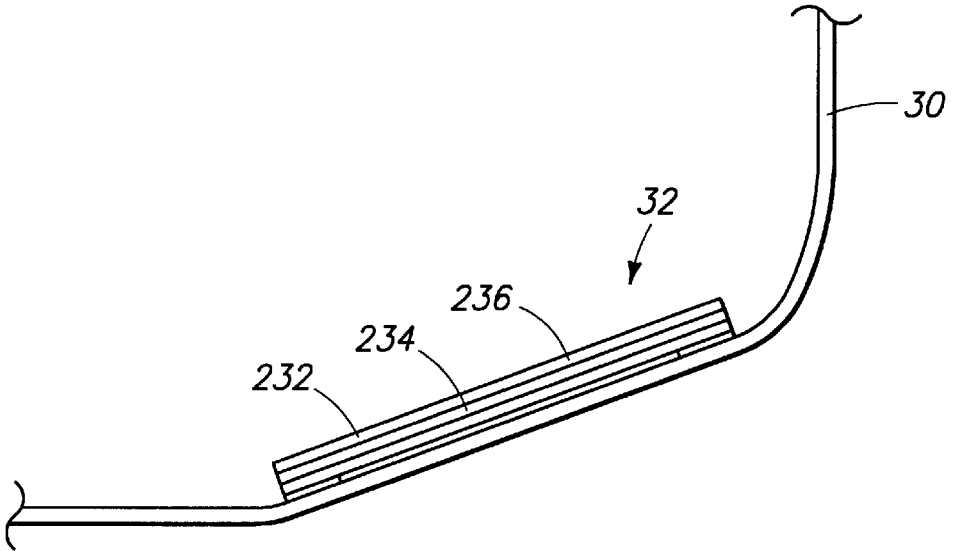
FIG. 5 is a fragmentary, cross-sectional sideview of the substrate of FIG. 4 fastened to a belt in accordance with a method of the present invention.

Substrate 32 of FIG. 4 is shown fastened to a belt 30 in FIG. 5. Since adhesive 94 is provided only at the peripheral region 90 of substrate 32, the fastening comprises fastening peripheral region 90 to belt 30 and not fastening central region 92 to belt 30. The fastening of only peripheral region 90 of substrate 32 to belt 30 can allow belt 30 to loop around a curve without dislodging a planar substrate 32.

Although in the shown embodiment substrate 32 comprises a square-shaped substrate, it is to be understood that the invention encompasses other embodiments (not shown) in which substrates have other shapes, such as, for example, rounded or rectangular. Although in the above-described embodiment adhesive is not provided within central region 92, it is to be understood that the invention encompasses other embodiments wherein adhesive is provided in central region 92 either solely, or in addition to the adhesive provided in peripheral region 90. Additionally, it is noted that while in the shown embodiment adhesive 94 is provided on substrate 32 before substrate 32 is fastened to belt 30, the invention encompasses other embodiments (not shown) wherein an adhesive is provided on belt 30 prior to fastening substrate 32 to belt 30, as well as embodiments wherein adhesive is provided to both substrate 32 and belt 30 prior to fastening substrate 32 to belt 30.

It is noted that in various applications encompassed by the present invention a substrate 32 can be adhered to belt 30 without adhesive. Such applications can include, for example, applications in which electrostatic forces are utilized to adhere a substrate 32 to a belt 30.

Figure 6:
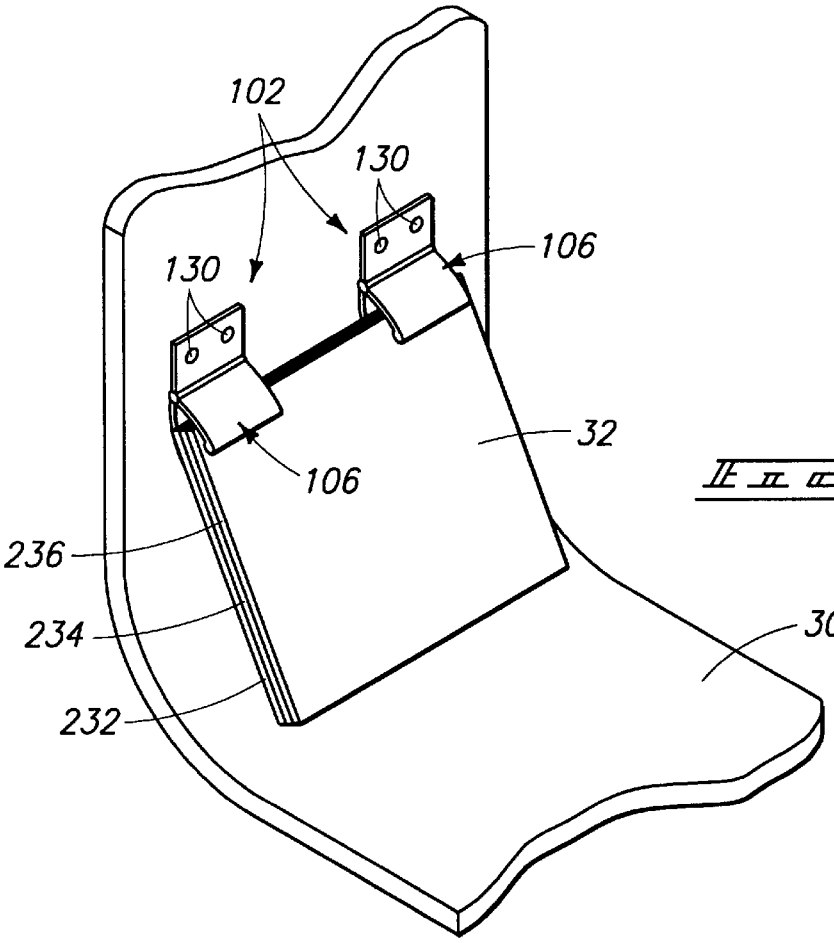
FIG. 6 is a fragmentary, perspective view of a substrate fastened to a belt in accordance with another aspect of the present invention.

Another embodiment mechanism for removably fastening a substrate 32 to a belt 30 is shown in FIG. 6. Specifically, FIG. 6 shows a substrate 32 removably fastened to a belt 30 by clips 102. Clips 102 are fastened to belt 30 by pins 130 which can comprise, for example, rivets. Each of clips 102 comprises clamping sections 106 configured to receive and retain substrate 32. Specifically, clips 102 are configured such that clamping members 106 can be opened for removal of substrate 32, and closed for retaining substrate 32. Clamping members 106 can, for example, be spring loaded to enable clamping members to removably retain substrates 32. Clips 102 can comprise for example, metal, and can be configured with compressible pads (not shown) to cushion a substrate that is retained within the clips. Such compressible pads can comprise, for example, rubber or plastic.

In the shown embodiment, two clips 102 are utilized. However, it is to be understood that the invention encompasses other embodiments (not shown) wherein less than two clips, or more than two clips are utilized. Also, although in the shown embodiment clips 102 are along only one side of substrate 32, it is to be understood that the invention encompasses other embodiments (not shown) wherein clips 102 are provided along more than one side of substrate 32.

Figure 7:
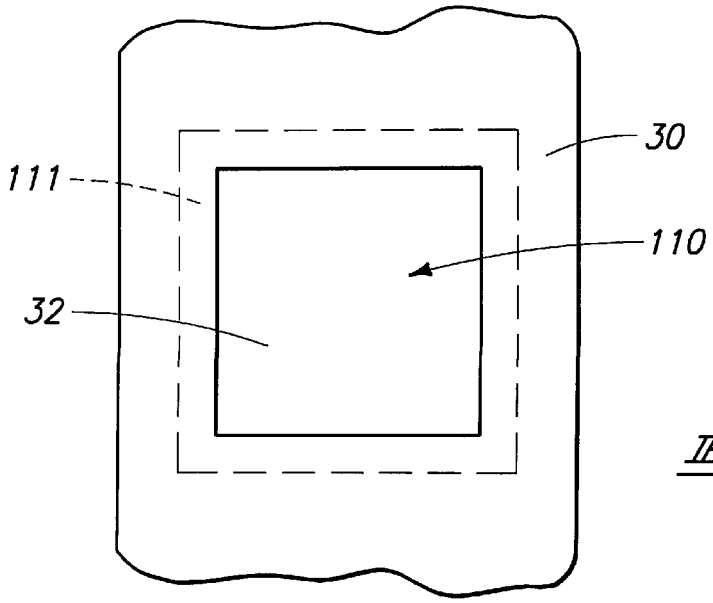
FIG. 7 is a fragmentary view of a substrate fastened to a belt in accordance with yet another aspect of the present invention.

Yet another embodiment mechanism for removably fastening a substrate 32 to a belt 30 is shown in FIG. 7. Specifically, FIG. 7 illustrates a belt 30 having an orifice 110 extending therethrough. A substrate 32 is fastened to belt 30 to have a surface exposed through orifice 110. Substrate 32 comprises a peripheral portion 111 (shown in phantom in FIG. 7) fastened to belt 30 by means of, for example, an adhesive or a clip, to retain substrate 32 against belt 30. The embodiment of FIG. 7, in contrast to embodiments of FIGS. 4 and 6, has substrate 32 retained against a backside of belt 30, rather than against a frontside.

Figure 8:
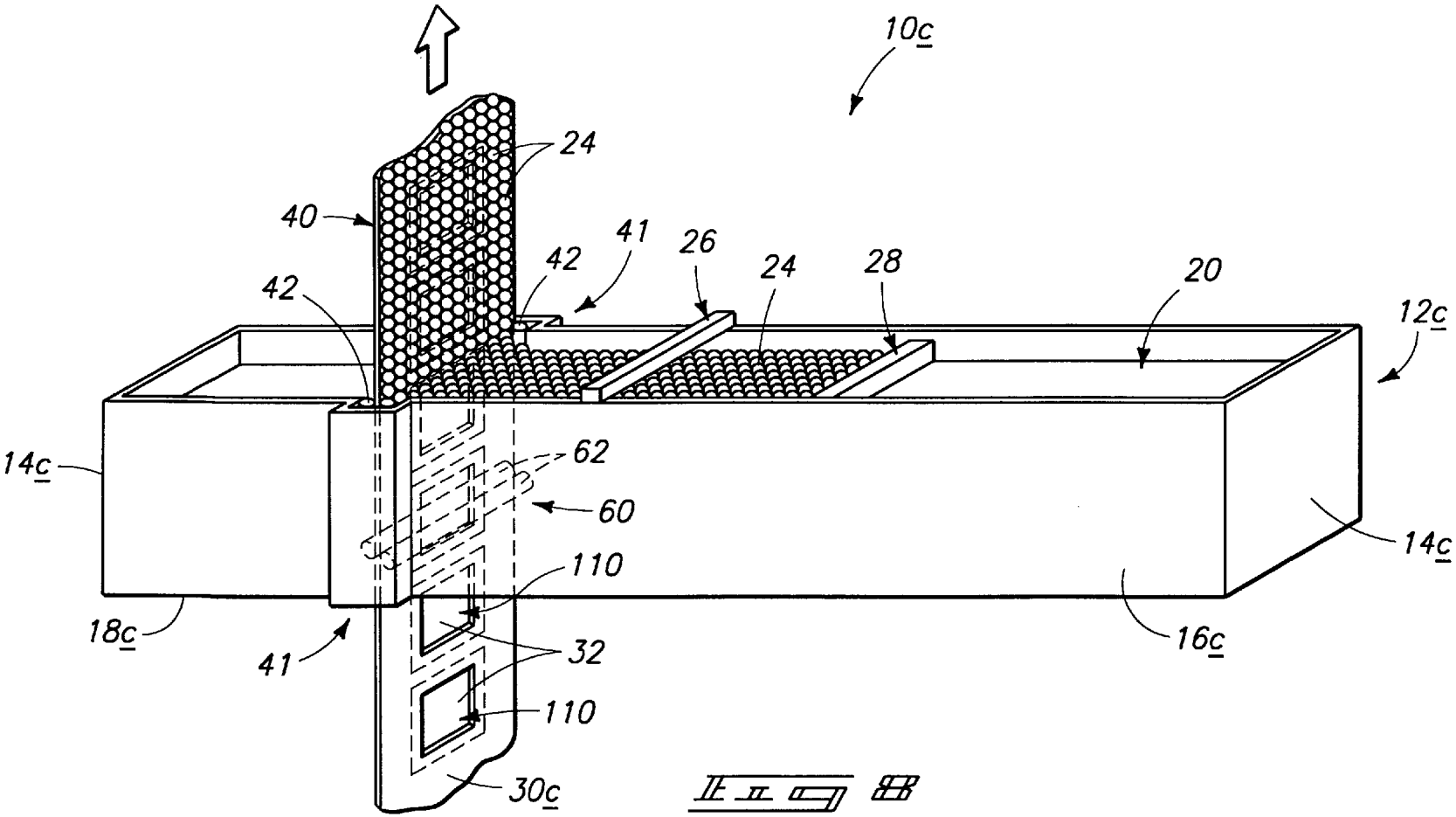
FIG. 8 is a fragmentary, perspective view of the substrate and belt assembly of FIG. 7 processed according to a method of the present invention.

FIG. 8 illustrates the substrate-retaining mechanism of FIG. 7 incorporated into an apparatus 10*c* of the present invention. In referring to the apparatus of FIG. 8, similar numbering to that utilized above in describing the embodiment of FIG. 1 will be used, with differences indicated by the suffix "c" or by different numerals.

Apparatus 10*c* comprises a vessel 12*c* containing a fluid 20. Apparatus 10*c* further comprises a particulate dispenser 26 and a pusher bar 28. Particulate dispenser 26 dispenses particulates 24 onto an upper surface of fluid 20. Pusher bar 28 compresses particulates 24 into a tightly packed monolayer. A belt 30*c*, comprising substrates 32 fastened thereto, is pulled upwardly through the monolayer to form a monolayer of particulates 24 on a surface of substrate 32. Belt 30*c* has a frontside 38, a backside 40, and orifices 110 extending from frontside 38 to backside 40.

Vessel 12*c*, like the vessel 12*a* of FIG. 2, comprises laterally projecting grooves 41 into which peripheral portions of belt 30*c* extend. Additionally, vessel 12*c* comprises sealing members 42 within grooves 40. Sealing members 42 can comprise, for example, gasket materials, such as, for example, rubber or plastic. Belt 30 is drawn upwardly between sealing members 42, and sealing members 42 prevent particulates 24 from migrating to backside 40 of belt 30*c*. Accordingly, only surfaces of substrates 32 that are exposed within orifices 110 are coated with particulates. The embodiments of FIGS. 7 and 8 can be advantageous in applications wherein a substrate comprises a peripheral portion that is not to be coated with particulates, in that such peripheral portion is effectively masked by belt 30*c* as substrate 32 is coated with a monolayer of particulates 24.

A substrate coated with particulates can be utilized in formation of emitter tips as described with reference to FIGS. 10–14. Referring first to FIG. 10, a substrate 32 is illustrated after formation of a monolayer of particulates 24 over an upper surface of substrate 32. Exemplary particulates 24 can comprise, for example, polystyrene beads or latex-comprising beads.

Figure 11:
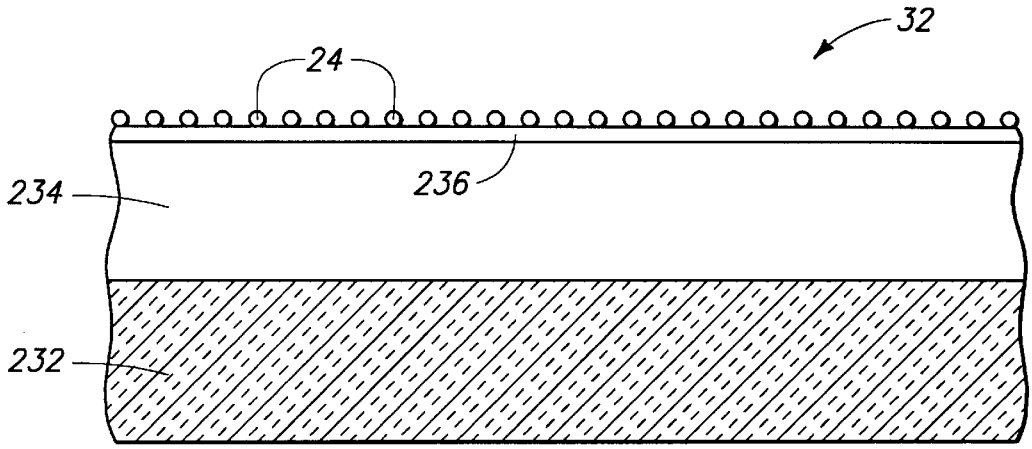
FIG. 11 is a view of the FIG. 9 substrate shown at a processing step subsequent to that of FIG. 10.
Figure 12:
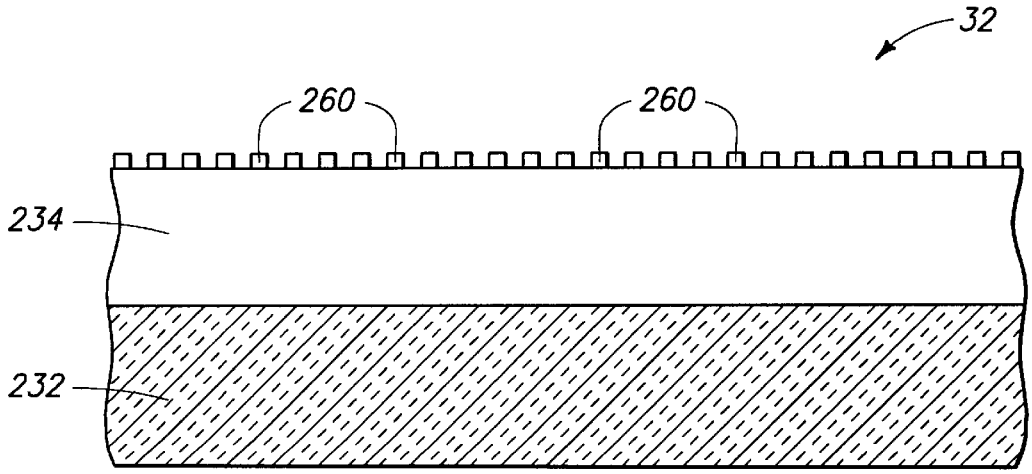
FIG. 12 is a view of the FIG. 9 substrate shown at a processing step subsequent to that of FIG. 11.

Referring to FIG. 11, substrate 32 is shown after particulates 24 have been exposed to conditions which decrease a dimension of the particulates. Particulates 24 now cover some portions of masking layer 236, while leaving other portions of masking material between particulates 24 uncovered. An example condition for shrinking polystyrene-comprising particulates 24 is exposure to an oxygen plasma to oxidize the beads and shrink them at a controlled rate. Another example method for reducing a dimension of the beads is to heat them to a temperature which evaporates materials from the beads. Yet another example method for reducing a dimension of the beads is to etch them with, for example, a chemical wet etch. In embodiments in which particulates 24 are spherical, a diameter of such spherical particulates 24 is preferably reduced at least about 20%, and more preferably at least to about 50% in going from the stage shown in FIG. 10 to that shown in FIG. 11. Referring to FIG. 12, substrate 32 is exposed to first etching conditions to remove portions of masking material 236 exposed between particulates 24 (FIG. 11), and subsequently particulates 24 are removed. Etching of masking layer 236 (FIG. 11) converts the masking layer to a patterned mask 260 which covers portions of semiconductive material 234 and leaves other portions uncovered. The first etching conditions are preferably highly anisotropic to remove material of masking layer 236 along a vertical profile without substantially undercutting particulates 24. Suitable etching processes can include, for example, plasma etching and reactive ion etching. In embodiments in which particulates 24 comprise latex and masking material 236 comprises silicon oxide, the first etching conditions can comprise, for example, an ion-assisted etch utilizing He and one or both of $CHF_3$ and $CF_4$. Suitable conditions for removing particulates 24 can include, for example, one or more of physical cleaning, chemical cleaning, or dry etching. An example method for removing particulates 24 from masking material 236 is by vibration of substrate 32 in an ultrasonic bath.

Figure 13:
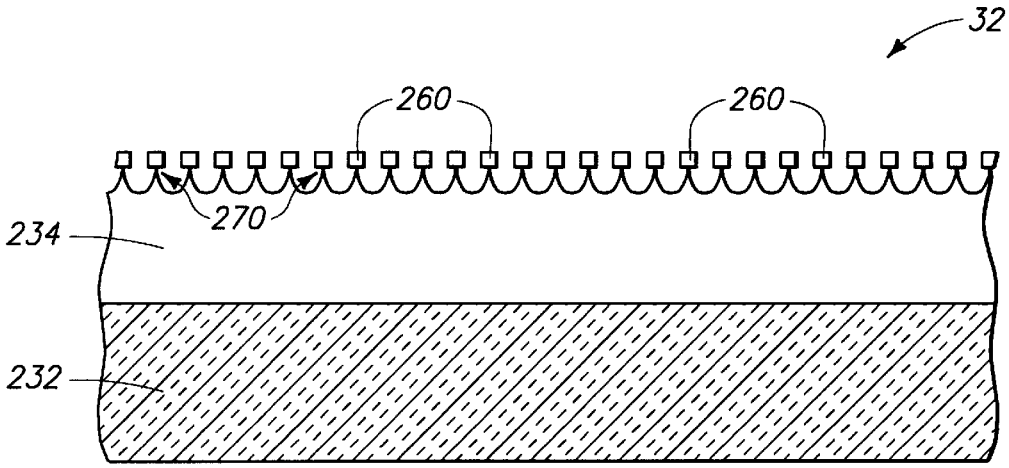
FIG. 13 is a view of the FIG. 9 substrate shown at a processing step subsequent to that of FIG. 12.

Referring to FIG. 13, substrate 32 is exposed to second etching conditions to etch exposed portions of material 234 and form conical emitter tips 270 (only some of which are labeled in FIG. 13) under patterned masking layer 260. In embodiments in which masking layer 260 comprises silicon dioxide and layer 234 comprises monocrystaline or amorphous silicon, second etching conditions can comprise isotropic etch processes known in the art.

Figure 14:
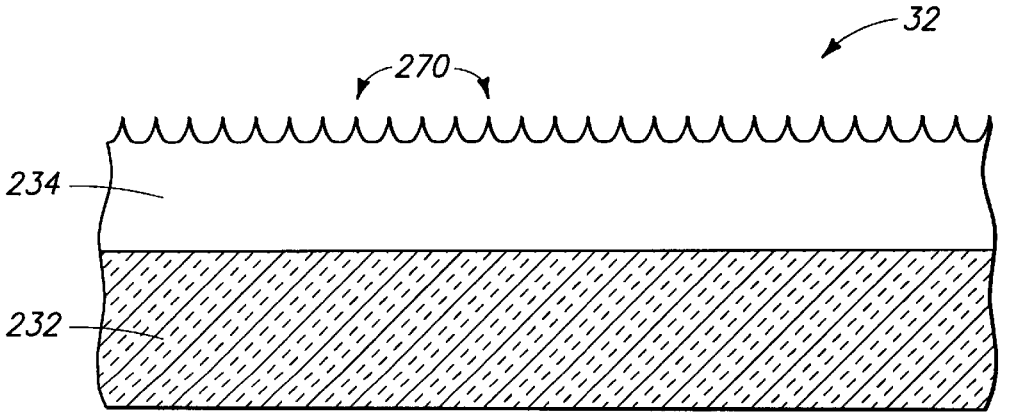
FIG. 14 is a view of the FIG. 9 substrate shown at a processing step subsequent to that of FIG. 13.

Referring to FIG. 14, patterned masking layer 260 is removed from substrate 32 to form an emitter tip array. In embodiments in which masking 260 comprises silicon dioxide, it can be removed by, for example, wet etching utilizing buffered hydrofluoric acid. The emitter tip array of FIG. 14 can be incorporated into, for example, a flat panel display device as an emitter assembly.

Although the invention is described with reference to conical tip formation from semiconductive substrates, it is to be understood that the invention can have application to etching of nonsemiconductive substrates, and can further have application to non-etch processes wherein particulate layers are formed over substrates.

It is noted that the invention encompasses embodiments wherein substrates are passed a single time through a suspended layer of particulates to form a layer of particulates on the substrates, as well as embodiments wherein the substrates make multiple passes through one or more suspended layers of particulates.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of forming a layer of particulates on a substrate, comprising:

fastening a substrate to a substrate support;

while the substrate is fastened to the substrate support, submerging at least a portion of the substrate in a liquid;

suspending particulates on an upper surface of the liquid;

moving the submerged substrate relative to the suspended particulates to form a layer of the particulates supported on the substrate;

removing the substrate from the substrate support; and utilizing the particulates as a mask to define portions of the substrate for formation of emitter tips.

2. The method of claim 1 wherein the removing occurs before the utilizing.

3. A method of forming a layer of particulates on a substrate, comprising:

fastening a substrate to a substrate support;

while the substrate is fastened to the substrate support, submerging at least a portion of the substrate in a liquid;

suspending particulates on an upper surface of the liquid;

moving the submerged substrate relative to the suspended particulates to form a layer of the particulates supported on the substrate;

removing the substrate from the substrate support;

wherein the substrate comprises a peripheral region and a central region, the central region being surrounded by the peripheral region;

wherein the fastening comprises fastening the peripheral region to the substrate support and not fastening the central region to the substrate support; and wherein the substrate support comprises openings extending therethrough; and wherein the fastening comprises fastening the peripheral region of the substrate to the substrate support to leave the central region of the substrate exposed within the openings, the layer of particulates being formed on the exposed central region.

4. A method of forming a layer on a substrate, comprising:

providing a liquid in a vessel, the liquid having an upper surface, the vessel having an opening extending therethrough below the upper surface of the liquid;

suspending particulates on an upper surface of the liquid to form a first suspended layer of particulates;

moving a substrate through the opening and upwardly through the upper surface of the liquid, the suspended particulates forming a layer of the particulates supported on the substrate; and utilizing the particulates as a mask to define portions of the substrate for formation of emitter tips.

5. The method of claim 4 wherein the utilizing the particulates comprises etching the substrate while the particulates are supported on the substrate.

6. A method of forming a layer on a substrate, comprising:

providing a liquid in a vessel, the liquid having an upper surface, the vessel having an opening extending therethrough below the upper surface of the liquid;

suspending particulates on an upper surface of the liquid to form a first suspended layer of particulates;

moving a substrate through the opening and upwardly through the upper surface of the liquid, the suspended particulates forming a layer of the particulates supported on the substrate; and forming a fluid-tight seal within the opening as the substrate is moved through the opening.

7. A method of forming a layer on a substrate, comprising:

providing a liquid in a vessel, the liquid having an upper surface, the vessel having an opening extending therethrough below the upper surface of the liquid;

suspending particulates on an upper surface of the liquid to form a first suspended layer of particulates;

moving a substrate through the opening and upwardly through the upper surface of the liquid, the suspended particulates forming a layer of the particulates supported on the substrate; and removably fastening the substrate to a support, the moving the substrate through the opening and upper surface comprising moving the substrate and support through the opening and upper surface of the liquid.

8. A method of forming a layer on a substrate, comprising:

providing a liquid in a vessel, the liquid having an upper surface;

suspending particulates on the upper surface of the liquid;

providing a pusher bar, the pusher bar having a pushing surface which compresses the particulates against one another;

providing a conveyor;

fastening a substrate to the conveyor;

drawing the conveyor into the liquid and upwardly through the suspended particulates, the conveyor having a front surface that faces the pushing surface of the pusher bar and a back surface in opposing orientation relative to the front surface;

the substrate being drawn upwardly through the suspended particulates with the conveyor;

as the substrate is drawn upwardly, the suspended particulates adhering to a surface of the substrate form a layer of the particulates supported on the substrate; and wherein the conveyor comprises lateral edges and wherein the vessel comprises a seal along the lateral edges of the conveyor that prevents the particulates from flowing around the conveyor and contacting the back surface of the conveyor.

9. The method of claim 8 wherein the suspended particulates form a monolayer over the upper surface of the liquid, the monolayer having a front surface proximate the conveyor and a back surface proximate the pushing surface of the pusher bar, an entirety of the front surface of the monolayer being against either the conveyor or the substrate fastened to the conveyor.

10. A method of forming a layer on a substrate, comprising:

providing a liquid in a vessel, the liquid having an upper surface;

suspending particulates on the upper surface of the liquid;

providing a pusher bar, the pusher bar having a pushing surface which compresses the particulates against one another;

providing a conveyor;

fastening a substrate to the conveyor;

drawing the conveyor into the liquid and upwardly through the suspended particulates, the conveyor having a front surface that faces the pushing surface of the pusher bar and a back surface in opposing orientation relative to the front surface;

the substrate being drawn upwardly through the suspended particulates with the conveyor;

as the substrate is drawn upwardly, the suspended particulates adhering to a surface of the substrate form a layer of the particulates supported on the substrate; and wherein the pusher bar has a back surface in opposing orientation to the pushing surface, the liquid upper surface proximate the pusher bar back surface not be covered with particulates, the drawing the conveyor into the liquid comprising drawing the conveyor through the liquid upper surface that is not coated with particulates.

11. A method of forming a layer on a substrate, comprising:

providing a liquid in a vessel, the liquid having an upper surface;

suspending particulates on the upper surface of the liquid;

providing a pusher bar, the pusher bar having a pushing surface which compresses the particulates against one another;

providing a conveyor;

fastening a substrate to the conveyor;

drawing the conveyor into the liquid and upwardly through the suspended particulates, the conveyor having a front surface that faces the pushing surface of the pusher bar and a back surface in opposing orientation relative to the front surface;

the substrate being drawn upwardly through the suspended particulates with the conveyor;

as the substrate is drawn upwardly, the suspended particulates adhering to a surface of the substrate form a layer of the particulates supported on the substrate;

wherein the vessel comprises an opening beneath the upper surface of the liquid, and wherein the drawing the conveyor into the liquid comprises drawing the conveyor through the opening in the vessel; and wherein some of the liquid leaks through the opening as the conveyor is drawn through the opening, the method further comprising recirculating the leaked liquid to the vessel.

12. A method of forming field emission emitter tips, comprising:

removably fastening a masking-material-covered semiconductor substrate to a support;

while the substrate is fastened to the support, submerging at least a portion of the substrate in a liquid;

suspending particulates on an upper surface of the liquid;

moving the submerged masking-material-covered substrate through the suspended particulates to form a layer of the particulates supported on the masking material of the masking-material-covered substrate;

removing the substrate from the support;

decreasing a dimension of the particulates to leave some portions of the masking material covered by the particulates and other portions of the masking material uncovered by the particulates;

after decreasing the dimension, exposing the masking-material-covered substrate to first etching conditions to remove uncovered portions of the masking material and define a patterned masking layer;

removing the particulates; and while the patterned masking layer is over the semiconductor substrate, exposing the semiconductor substrate to a second etching conditions to pattern the semiconductor substrate into emitter tips.

13. The method of claim 12 wherein the support comprises a continuous belt of material.

14. The method of claim 12 wherein the fastening comprises providing an adhesive between the substrate and the support.

15. The method of claim 12 wherein the fastening comprises providing an adhesive tape between the substrate and the support.

16. The method of claim 12 further comprising joining a clip to the one of the substrate and the support and wherein the fastening comprises compressing a portion of the other of the substrate and the support with the clip.

17. The method of claim 16 wherein the clip is joined to the support.

18. The method of claim 12 wherein the substrate comprises a peripheral region and a central region, the central region being surrounded by the peripheral region, and wherein the fastening comprises fastening one of the peripheral region and the central region to the support and not fastening the other of the central region and the peripheral region to the support.

19. The method of claim 12 wherein the substrate comprises a peripheral region and a central region, the central region being surrounded by the peripheral region, and wherein the fastening comprises fastening the peripheral region to the support and not fastening the central region to the support.

20. The method of claim 19 wherein the support comprises openings extending therethrough and wherein the fastening comprises fastening the peripheral region of the substrate to the support to leave the central region of the substrate exposed within the openings, the layer of particulates being formed on the exposed central region.

21. The method of claim 12 wherein the support is more flexible than the substrate, and wherein the substrate comprises a peripheral region and a central region, the central region being surrounded by the peripheral region, and wherein the fastening comprises fastening the peripheral region to the support and not fastening the central region to the support.

22. The method of claim 21 wherein the support comprises a continuous belt of material.

23. The method of claim 12 wherein the substrate comprises a semiconductive material.

* * * * *